United States Patent [19]

Ashby

[11] Patent Number: 4,896,822

[45] Date of Patent: Jan. 30, 1990

[54] APPARATUS AND METHODS FOR FORMING MAILERS WITH INSERTS

[75] Inventor: Robert E. Ashby, Quakertown, Pa.

[73] Assignee: Moore Business Forms, Inc., Grand Island, N.Y.

[21] Appl. No.: 333,235

[22] Filed: Apr. 5, 1989

[51] Int. Cl.[4] ..... B65D 27/10

[52] U.S. Cl. ..... 229/69

[58] Field of Search ..... 229/69

[56] References Cited

U.S. PATENT DOCUMENTS

| | | | |
|---|---|---|---|
| 2,013,844 | 9/1935 | Sherman | 729/69 |
| 2,328,081 | 8/1943 | Johnson | 282/11.5 |
| 2,332,637 | 10/1943 | Heywood | 229/69 |
| 2,338,922 | 1/1944 | Fleming | 229/69 |
| 2,371,791 | 3/1945 | Berggren | 270/52 |
| 3,544,438 | 1/1971 | Malderghem | 229/69 |
| 3,941,308 | 3/1976 | Digorolomo et al. | 229/69 |
| 4,070,223 | 1/1978 | Stalzer | 156/264 |
| 4,108,352 | 8/1978 | Peschke | 229/69 |
| 4,285,531 | 8/1981 | Balsamo | 281/5 |
| 4,361,269 | 11/1982 | Neubauer | 229/69 |
| 4,448,558 | 5/1984 | Weingarten | 400/529 |
| 4,461,661 | 7/1984 | Fabel | 229/69 |
| 4,492,334 | 1/1985 | Dicker | 229/69 |
| 4,525,399 | 6/1985 | Fields | 428/43 |
| 4,645,123 | 2/1987 | Ashby | 229/69 |
| 4,715,530 | 12/1987 | Leese et al. | 229/69 |
| 4,728,027 | 3/1988 | Steidinger | 229/69 |

FOREIGN PATENT DOCUMENTS

| | | | |
|---|---|---|---|
| 1558515 | 1/1980 | United Kingdom | 229/69 |

*Primary Examiner*—Stephen Marcus
*Assistant Examiner*—K. M. Stemann
*Attorney, Agent, or Firm*—Nixon & Vanderhye

[57] ABSTRACT

The form includes a pair of outer panels with an insert therebetween. Corresponding ends of the panels and inserts have registering marginal feed strips. The insert has an additional marginal feed strip extending outwardly of the panels at each of the opposite ends thereof. The insert is formed of heavier material than the panels. The transversely extending edges of the insert are set back from the transverse edges of the panels, the latter being adhesively secured one to the other. Problems in tenting are thus avoided.

14 Claims, 3 Drawing Sheets

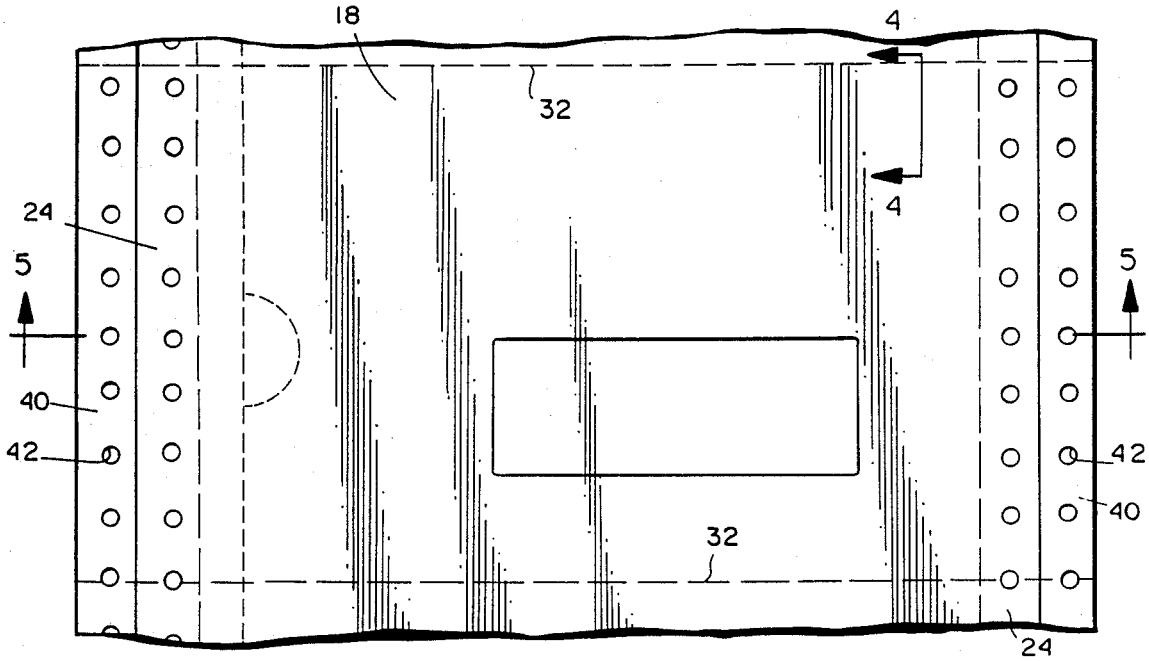
FIG. 2
FIG. 4
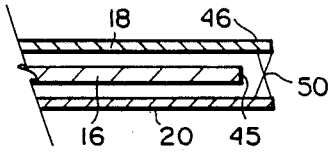
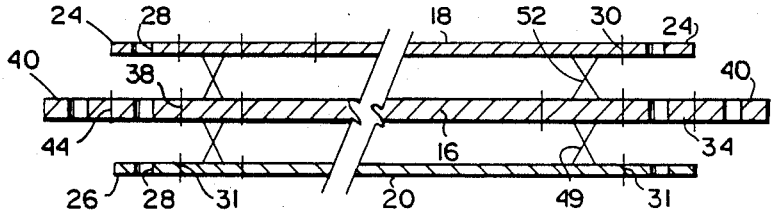
FIG. 5
FIG. 3
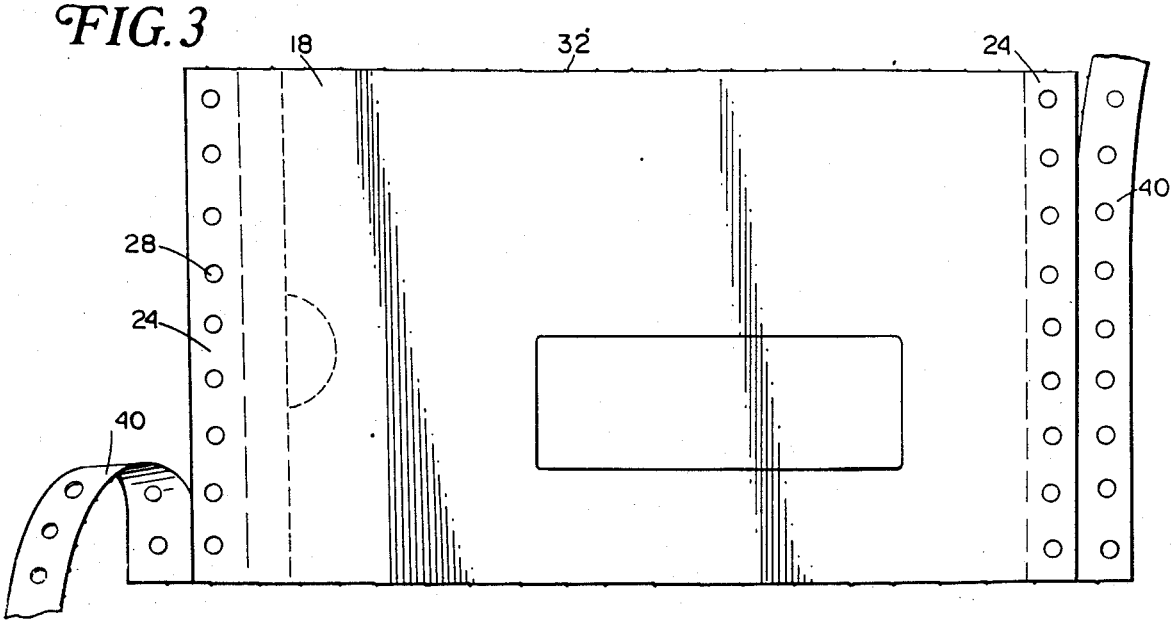

APPARATUS AND METHODS FOR FORMING MAILERS WITH INSERTS

BACKGROUND AND SUMMARY OF THE INVENTION

The present invention relates to a continuous business forms assembly and methods of making the forms assembly and, more particularly, relates to a business forms assembly including plural, serially connected mailers with inserts of a material heavier than the material of the panels forming the mailers and methods of making the forms assembly wherein problems of tenting are minimized or eliminated.

Many and various types of multiple ply continuous business form assemblies have been provided in the past. The intermediate ply or plies of a multiple ply business form assembly conventionally form the insert or inserts for the mailer. In most mailers, the outermost and intermediate plies are normally provided with marginal feed strips whereby automated machine processing of the forms may be accomplished.

Tenting has been a particular problem in multiple ply forms and particularly those with inserts. Moreover, inserts are desirably formed of a material heavier in weight than the material of the outer mailing panels or plies encompassing the insert. The use of heavier insert material compounds the problems of tenting. As those familiar with this art will appreciate, continuous business form assemblies are usually Z-folded into stacks of forms, the panels of each form usually being secured one to the other along transverse foldlines which also define each of the forms. Thus, when the forms are folded, the thickness of the panels and insert cause the folded forms to stack unevenly and also tend to move the forms toward unfolded positions. This problem is exacerbated when the insert is formed of material heavier than the material forming the outer panels.

Additionally, inserts formed of heavier material prove to be difficult in processing through business forms machinery because of the stiffness in the marginal areas. For example, in collating business forms or multiple unit sets of forms, tractor feeds engaging the marginal feed strips of the webs are used to move the continuous webs, including the web forming the insert, through die cutting operations and a lamination station where the webs and inserts are assembled. Stiffness in the marginal areas of the heavier webs or inserts often causes difficulty in the hold-down plates of the tractor assemblies.

In accordance with the present invention, there is provided a continuous business form of a type constituting a plurality of serially connected mailers, each having a pair of outer panels and one or more inserts disposed between the outer panels. The inserts may be formed of a material heavier than the material forming the outer panels. To eliminate or minimize tenting problems when folding the continuous business forms, the inserts are die cut in the area of the separation line between adjoining forms. Thus, the transversely extending margins of the inserts are longitudinally spaced from the margins of the panels which are coincident with the separation lines of the forms. With the insert being cut back in the fold areas of the forms, the forms can be readily Z-folded in such manner that the additional bulk of the insert material does not substantially contribute to the tenting problem.

Additionally, to further facilitate feeding the forms through collaters, where the forms have heavyweight insert sheet material, the web forming the insert is provided with an additional marginal feed strip along each of its opposite edges. That is, the margins of the webs forming the outer panels of the individual mailers are provided with feed strips containing prepunched holes which align with marginal feed strips likewise provided with prepunched holes on the web forming the inserts. However, the web forming the insert has an additional marginal feed strip with prepunched holes along each of its lateral margins and which additional feed strips extend beyond the ends of the marginal feed strips of the webs forming the individual mailer panels. Consequently, when the form is collated, i.e., when the webs forming the outer panels and the interior inserts between such outer panels are brought into registration and secured, the registering marginal feed strips of the outer mailer panels and the interior or innermost marginal feed strips of the insert or inserts which register with the marginal feed strips of the outer panels align with the conventional feed assemblies. However, the additional marginal feed strips extend transversely beyond the normal form width. Thus, these additional outer marginal feed strips enable the tractor feed to carry the insert. This avoids difficulties associated with transporting a heavier insert with the registering marginal feed strips of the mailer panels. That is, no additional bulk is provided in the margin other than the bulk of the insert itself, and which additional bulk might otherwise snap open the tractor hold-down plates. Once the form is collated, including adhesively attaching the panels one to the other along their transverse edges outboard of the die cut transverse margins of the insert, the outer marginal feed strips may be removed, either as part of the collating operation or offline on a de-collater. Consequently, the form will be quite flexible in the fold and off-fold areas, thereby improving form feeding. Additionally, all adhesive is applied between the lightweight outer webs on opposite sides of the inserts in the fold and off-fold areas, thereby reducing tenting.

In a preferred embodiment according to the present invention, there is provided a mailer product, comprising a pair of panels each having opposite end portions, each end portion including a marginal feed strip with longitudinally extending spaced perforations therealong, an insert having first and second marginal feed strips each with longitudinally extending spaced perforations therealong, the first and second feed strips lying adjacent each of opposite end portions of the insert, the insert being disposed between the panels with the first feed strip at each end of the insert in registry with the feed strips of the panels at the corresponding end of the mailer, each second feed strips extending outwardly of the corresponding end of the panels.

In a further preferred embodiment according to the present invention, there is provided a serially connected, continuous form mailer product, comprising a plurality of mailers, each of the mailers including a pair of panels each having opposite end portions, each end portion including a marginal feed strip with longitudinally extending spaced perforations therealong, an insert for each mailer having first and second marginal feed strips each with longitudinally extending spaced perforations therealong, the first and second feed strips lying adjacent each of opposite end portions of the insert, the insert being disposed between the panels of a corresponding mailer with the first feed strip at each end of the insert in registry with the feed strips of the panels at the corresponding end of the mailer, each second feed strips extending outwardly of the corresponding end of the panels, each insert being formed of a material heavier than the material forming the panels and each mailer being generally rectilinear in shape, the feed strips thereof being disposed along its opposite ends, the long transversely extending edges of each insert being inset from the long transversely extending edges of the panels of the corresponding mailer, and means extending longitudinally beyond the transversely extending edges of the insert for securing the transversely extending edges of the panels of the corresponding mailer one to the other. Means are also provided for releasably securing the panels of each mailer of the continuous form to an adjoining mailer along the transversely extending edges thereof enabling the form to be folded thereabout in a manner to substantially preclude tenting thereof.

In a still further preferred embodiment according to the present invention, there is provided a method of forming a continuous mailer product separable to provide discrete mailers each having a pair of panels enclosing an insert comprising the steps of providing a pair of continuous webs each having a longitudinally extending feed strip along its opposite sides with each strip having a plurality of perforations longitudinally spaced one from the other therealong, providing a third continuous web having a pair of marginal feed strips along each of its opposite sides with each strip having a plurality of perforations longitudinally spaced one from the other therealong, die cutting the third web at longitudinally spaced locations therealong to define a plurality of inserts with longitudinally inset margins extending transversely from the pair of feed strips along one side of the third web to the pair of feed strips along the opposite side of the third web, applying an adhesive to one of the pair of webs at transversely extending longitudinally spaced positions therealong, transporting the third web, using the outermost feed strips of each pair thereof as part of a transporting mechanism, between the pair of webs so that transversely extending portions of the webs overlie one another and are directly adhesively secured to one another in the the die cut areas of said insert, providing a transversely extending separating line along the pair of webs at longitudinally spaced positions therealong for dividing the webs upon separation along the separating lines into discrete panels and folding the panels in Z fashion along the separating lines with the inserts spaced at least along one transversely extending marginal edge thereof from the foldline to avoid tenting.

Accordingly, it is a primary object of the present invention to provide a continuous business form assembly and method of forming the assembly which facilitates feeding the forms through processing machines, particularly where heavyweight inserts are involved.

These and further objects and advantages of the present invention will become more apparent upon reference to the following specification, appended claims and drawings.

BRIEF DESCRIPTION OF THE DRAWING FIGURES

FIG. 2 is a fragmentary plan view of the continuous business form assembly hereof, illustrating a single form or mailer and its attachment to adjacent forms or mailers;

FIG. 3 is a view similar to FIG. 2, illustrating the removal of the marginal feed strips for the insert;

Figure 6:
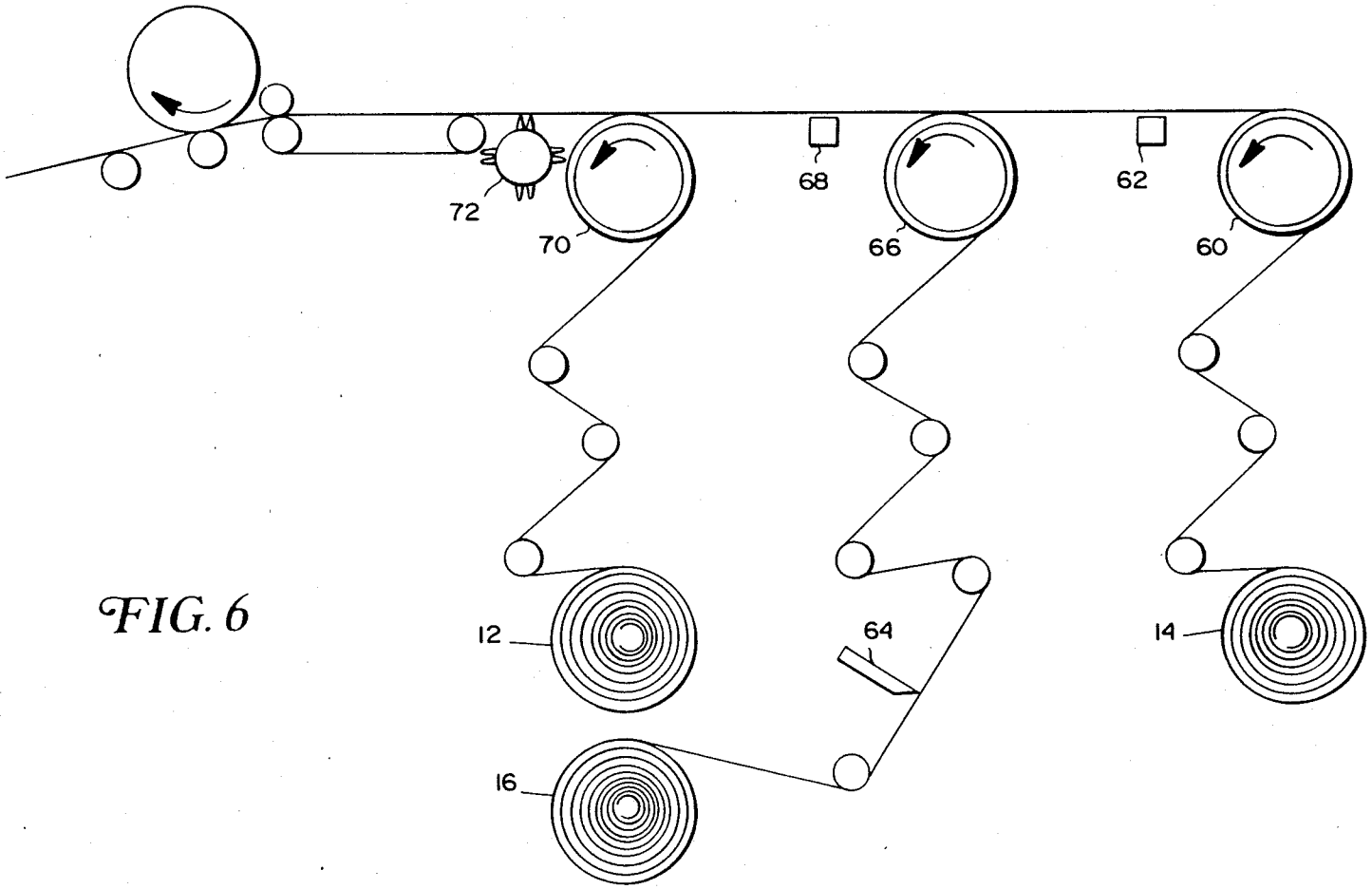

FIGS. 4 and 5 are fragmentary cross-sectional views of the continuous business forms assembly illustrated in FIG. 2 and taken generally about on lines 4—4 and 5—5, respectively, in FIG. 2; and FIG. 6 is a schematic illustration of a method of manufacturing the continuous business forms assembly hereof.

DETAILED DESCRIPTION OF THE DRAWING FIGURES

Reference will now be made in detail to the present preferred embodiment of the invention, an example of which is illustrated in the accompanying drawings.

Figure 1:
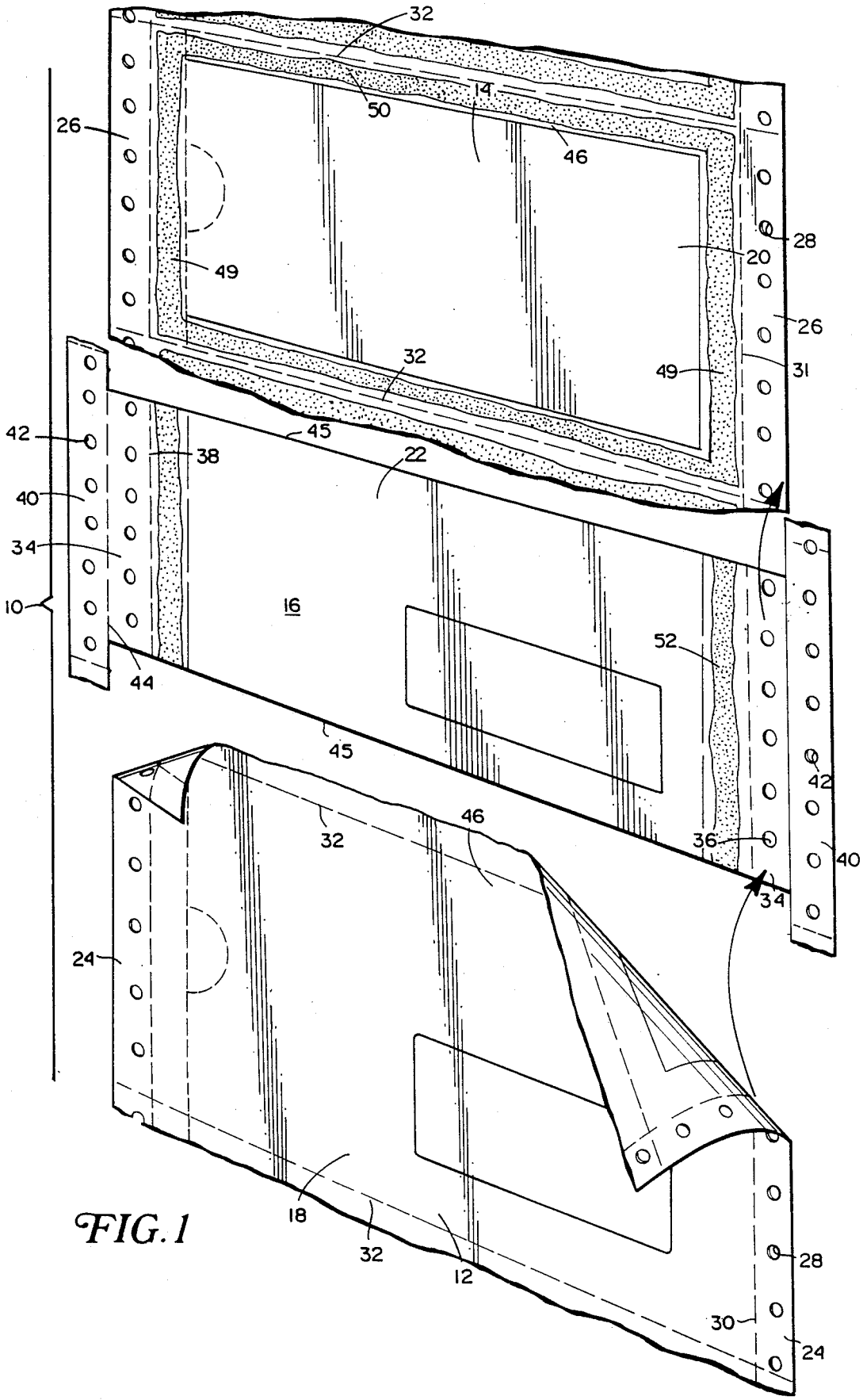
FIG. 1 is a fragmentary exploded perspective view of the outer panels and insert therebetween for individual forms or mailers illustrated as part of a continuous business form assembly.

Referring now to the drawings, particularly to FIG. 1, there is illustrated a continuous business form assembly, generally designated 10, comprised of a plurality of webs of material, preferably paper, secured together in a manner to be described. The webs are continuous and fed from rolls (FIG. 6) and, in the illustrated preferred embodiment, three webs are collated to form a series of discrete forms serially connected one to the other along the continuous business forms assembly 10. More particularly, the assembly 10 includes a pair of outer webs 12 and 14 and an intermediate web 16, collated in a manner to be set forth.

As illustrated in FIG. 1, webs 12, 14 and 16 constitute the plies of individual forms which, in the preferred embodiment hereof, constitute mailers 18 (FIG. 3). Each mailer is therefore comprised of a pair of panels enclosing the insert panel. Particularly, panels 18 and 20 are formed from the webs 12 and 14, respectively, while insert panel 22 is formed from the intermediate web 16.

As illustrated, each of the webs 12 and 14 which form the series of discrete panels 18 and 20 of the mailers, are provided with marginal feed strips 24 and 26, respectively. Each feed strip has a plurality of longitudinally spaced pinfeed openings or perforations 28. The marginal feed strips 24 and 26 extend longitudinally along opposite sides of the webs 12 and 14, respectively, and the strips on each side thereof lie in registration with one another when the webs are collated to form the series connected mailers. Each of the marginal strips 24 and 26 are separated from the main body of the corresponding panels 18 and 20, respectively, by longitudinally extending lines of perforations 30 and 31 which likewise lie in registration one with the other along opposite sides of the assembly 10 when the webs are collated. Transversely extending lines of perforations 32 are provided along each web 12 and 14 at longitudinally spaced positions therealong to define the discrete panels 18 and 20, respectively, and further define separation lines between adjacent mailers or folders after collation of the webs. The separation lines constituting perforation lines 32 extend through the marginal feed strips 24 and 26 at the opposite ends of the mailers.

The web 16 which forms the insert panels 22 is, as best illustrated in FIGS. 4 and 5, formed of a heavier material than the material forming the panels 18 and 20. Particularly, the web 16 is thicker than the webs 12 and 14. The web 16 is provided adjacent each of its opposite sides with a first or interior marginal feed strip 34 having longitudinally spaced pinfeed holes 36. The marginal feed strips 34 along opposite sides of the intermediate web 16, upon collation of the webs, lie in registration with the marginal feed strips 24 and 26 of the webs 12 and 14, respectively. The marginal feed strips 34 are separated from the main portion of each insert panel 16 by a longitudinally extending line of perforation 38 inwardly thereof adjacent opposite ends of each insert panel 22. Lines of perforation 38 at opposite ends thereof lie in registration with lines of perforation 30 and 31 of the webs 12 and 14, respectively, upon collation thereof.

In accordance with the present invention, an additional marginal feed strip 40 with longitudinally spaced pinfeed holes 42 is provided outwardly of each of the marginal feed strips 34 extending along web 16. Marginal feed strips 40 are connected to marginal feed strips 34 by longitudinally extending lines of perforation 44. As evident from FIG. 5, the marginal feed strips 40 extend outwardly of the marginal feed strips 34 upon collation of the webs and do not register with any of the material forming the webs 12 and 14.

Also, in accordance with the present invention, the intermediate web 16 is die cut between the outer marginal feed strips 40 such that each insert panel 22 formed is smaller in longitudinal direction of the web than the longitudinal extent of each of the panels 18 and 20 of webs 12 and 14, respectively. Additionally, the die cut straddles the transversely extending lines of perforation 32 such that the transversely extending margins 45 of the insert panel 22 are inset from the lines of perforations 32 constituting the foldlines of the continuous business form assembly 10. Therefore, as best illustrated in FIG. 4, transversely extending margins 46 of the panels 18 and 20, respectively, lie not only in registration one with the other after collation, but in contact one with the other, for purposes which will become apparent from the ensuing description.

To collate the webs, adhesive is applied in longitudinally extending strips 49 thereof inwardly of the lines of perforations 31 on the web 14, as well as in transversely extending lines 50 thereof on opposite sides of the transversely extending perforation lines 32. Additionally, lines of adhesive 52 are provided inwardly of the marginal feed strips 34 of insert panels 22. Thus, when the panels 18, 20 and 22 lie in registration one with the other, with the marginal feed strips 24, 26 and 34 in registration and the transversely extending lines of perforation 32 in registration, the longitudinally extending lines of adhesive 49 secure the panel 20 to the backside of the insert panel 22 inwardly of the marginal feed strips 34. Furthermore, the transversely extending lines of adhesive 50 secure the marginal portions of the back panel 20 to the margins of the front panel 18. It will be appreciated that the transversely extending lines of adhesive 50 are spaced longitudinally from the transversely extending edges 45 of the insert panel 22. It will also be noted that the die cut extends through the marginal feed strips 34 but does not extend through the outer marginal feed strips 40. Consequently, as illustrated in FIG. 5, the insert is secured to the one panel 18 by longitudinally extending lines of adhesive 52, with the outer marginal feed strips 40 extending outwardly beyond the marginal feed strips 24 and 26 of panels 18 and 20, respectively. Additionally, it will be noted that the marginal edges 45 of each insert panel 22 are thus set back from the lines of perforation 32. In this manner, the individual forms or mailers may be Z-folded about the separation lines 32, with only the two thin panel portions of the webs 18 and 20 in the area of the fold. Consequently, the marginal feed strips 40 may be used to transport the heavier insert material with the lighter weight outer web materials 12 and 14. After collation, or as part of an offline de-collator, the marginal feed strips 40 may be removed by tearing along the longitudinally extending perforation lines 44.

Referring now to FIG. 6, it will be appreciated that the webs 12, 14 and 16 may be taken from continuous rolls and provided on a collator having various rolls. For example, the web 14 may be disposed about a drum 60 for movement over a glue pot 62 whereby the longitudinally extending lines of adhesive, as well as the transversely extending lines of adhesive may be applied to the underside of the web 14. The intermediate web 16 may be removed from the roll and die cut, as schematically illustrated at 64, at longitudinally spaced positions therealong. The die cut web 16 may then be fed over a roll 66 and past a glue pot 68 for applying glue to the underside of the web, for example, to define the lines of adhesive 52. Finally, the web 12 may be disposed about roll 70 for collation with the webs 14 and 16. A feed mechanism 72 engages in the outermost marginal feed strips 40 to convey the collated webs downstream for various and further processing.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mailer product, comprising:

a pair of panels each having opposite end portions, each said end portion including a marginal feed strip with longitudinally extending spaced perforations therealong;

an insert having first and second marginal feed strips each with longitudinally extending spaced perforations therealong, said first and second feed strips lying adjacent each of opposite end portions of said insert;

said insert being disposed between said panels with the first feed strip at each end of said insert in registry with the feed strips of said panels at the corresponding end of the mailer, each said second feed strips extending outwardly of the corresponding end of said panels.

2. A product according to claim 1 wherein said insert is formed of a material heavier than the material forming said panels.

3. A product according to claim 1 wherein the product is generally rectilinear in shape, said feed strips being disposed along the opposite ends of said product, the long transversely extending edges of said insert being inset from the long transversely extending edges of said panels, and means for securing said transversely extending edges of said panels one to the other.

4. A product according to claim 3 wherein said securing means includes an adhesive applied between said transversely extending edges of said panels.

5. A product according to claim 1 including a line of perforations along each marginal feed strip on said panels whereby each feed strip can be separated from the remaining portion of the associated panel, and a line of perforations between each of said first and second feed strips and between said first feed strip and the remaining portion of said insert.

6. A product according to claim 5 wherein the line of perforations between said first and second feed strips lies in registry with the end edge of said panels at each of the opposite ends of the product and the line of perforations between said first feed strip and said remaining portion of said insert lies in registry with the lines of perforation in said panels at each of the opposite ends of said product.

7. A product according to claim 1 wherein said panels terminate at their opposite end portions in the feed strips thereof with said second feed strips constituting the sole outwardly projecting portion of the product outwardly of said panels.

8. A product according to claim 1 wherein said insert is formed of a material thicker than the material forming each said panel.

9. A product according to claim 1 wherein said insert is formed of a material heavier than the material forming said panels, the product being generally rectilinear in shape, said feed strips being disposed along the opposite ends of said product, the long transversely extending edges of said insert being inset from the long transversely extending edges of said panels, and means for securing said transversely extending edges of said panels one to the other.

10. A product according to claim 3 wherein said insert is formed of a material heavier than the material forming said panels.

11. A product according to claim 9 wherein said securing means includes an adhesive applied between said transversely extending edges of said panels, a line of perforations along each marginal feed strip on said panels whereby each feed strip can be separated from the remaining portion of the associated panel, and a line of perforations between each of said first and second feed strips and between said first feed strip and the remaining portion of said insert, the line of perforations between said first and second feed strips lying in registry with the end edge of said panels at each of the opposite ends of the product and the line of perforations between said first feed strip and said remaining portion of said insert lying in registry with the lines of perforation in said panels at each of the opposite ends of said product.

12. A product according to claim 10 wherein the long transversely extending edges of said insert are inset from the long transversely extending edges of said panels, means for securing said transversely extending edges of said panels one to the other including an adhesive applied between said transversely extending edges of said panels, a line of perforations along each marginal feed strip on said panels whereby each feed strip can be separated from the remaining portion of the associated panel, and a line of perforations between each of said first and second feed strips and between said first feed strip and the remaining portion of said insert, the line of perforations between said first and second feed strips lying in registry with the end edge of said panels at each of the opposite ends of the product and the line of perforations between said first feed strip and said remaining portion of said insert lying in registry with the lines of perforation in said panels at each of the opposite ends of said product.

13. A serially connected, continuous form mailer product, comprising:

a plurality of mailers, each of said mailers including a pair of panels each having opposite end portions, each said end portion including a marginal feed strip with longitudinally extending spaced perforations therealong;

an insert for each mailer having first and second marginal feed strips each with longitudinally extending spaced perforations therealong, said first and second feed strips lying adjacent each of opposite end portions of said insert;

said insert being disposed between the panels of a corresponding mailer with the first feed strip at each end of said insert in registry with the feed strips of said panels at the corresponding end of the mailer, each said second feed strips extending outwardly of the corresponding end of said panels, each said insert being formed of a material heavier than the material forming said panels;

each said mailer being generally rectilinear in shape, said feed strips thereof being disposed along its opposite ends, the long transversely extending edges of each said insert being inset from the long transversely extending edges of the panels of the corresponding mailer, and means extending longitudinally beyond the transversely extending edges of said insert for securing said transversely extending edges of the panels of the corresponding mailer one to the other; and means for releasably securing the panels of each mailer of said continuous form to an adjoining mailer along the transversely extending edges thereof enabling the form to be folded thereabout in a manner to substantially preclude tenting thereof.

14. A product according to claim 13 including a line of perforations along each marginal feed strip on said panels whereby each feed strip can be separated from the remaining portion of the associated panel, a line of perforations between each of said first and second feed strips and between said first feed strip and the remaining portion of said insert, the line of perforations between said first and second feed strips lying in registry with the end edge of said panels at each of the opposite ends of each mailer and the line of perforations between the first feed strip and said remaining portion of said insert lying in registry with the lines of perforation in said panels at each of the opposite ends of each said mailer.

* * * * *